US008033396B2

(12) United States Patent
Mendez

(10) Patent No.: US 8,033,396 B2
(45) Date of Patent: Oct. 11, 2011

(54) METHOD AND APPARATUS FOR ARRANGING, TRANSPORTING, AND/OR SERVING FOOD

(75) Inventor: Miguel Angel Mendez, Hillsboro, OR (US)

(73) Assignee: Klassic Corporation, Portland, OR (US)

( * ) Notice: Subject to any disclaimer, the term of this patent is extended or adjusted under 35 U.S.C. 154(b) by 0 days.

(21) Appl. No.: 12/615,186

(22) Filed: Nov. 9, 2009

(65) Prior Publication Data

US 2010/0051500 A1 Mar. 4, 2010

Related U.S. Application Data

(63) Continuation-in-part of application No. 29/280,768, filed on Jun. 6, 2007, now Pat. No. Des. 606,396.

(51) Int. Cl.
*B65D 6/04* (2006.01)

(52) U.S. Cl. ..... 206/561; 206/557; 206/565; 206/592

(58) Field of Classification Search ..... 229/23; 206/561, 521.1, 589; 273/1 S
See application file for complete search history.

(56) References Cited

U.S. PATENT DOCUMENTS

| | | | |
|---|---|---|---|
| 773,814 | A | 11/1904 | Shotts |
| 782,544 | A | 2/1905 | Carrier |
| 823,934 | A | 6/1906 | Davidson |
| 1,112,642 | A | 10/1914 | Morgenstern |
| 1,412,971 | A | 4/1922 | Sayo |
| 1,600,687 | A | 9/1926 | Mantz |
| 1,650,337 | A | 11/1927 | Fletcher |
| 1,689,069 | A | 10/1928 | Carver et al. |
| 1,727,706 | A | 9/1929 | Hitt |
| 2,084,423 | A | 6/1937 | Battye |
| 2,132,666 | A | 10/1938 | Williams |
| 2,133,336 | A | 10/1938 | Ziemmerman |
| 2,151,066 | A | 3/1939 | Anderson |
| 2,163,060 | A | 6/1939 | Ray |
| 2,174,687 | A | 10/1939 | Comley |
| 2,304,373 | A | 12/1942 | Palmer |
| 2,307,076 | A | 1/1943 | Ray |
| 2,319,974 | A | 5/1943 | Buttery |
| 2,320,665 | A | 6/1943 | Shearer |
| 2,352,393 | A | 6/1944 | Lee |

(Continued)

FOREIGN PATENT DOCUMENTS

GB EC683602-0003 3/2007

*Primary Examiner* — J. Gregory Pickett
*Assistant Examiner* — Raven Collins
(74) *Attorney, Agent, or Firm* — Marger Johnson & McCollom, P.C.

(57) ABSTRACT

A method and apparatus for arranging, transporting, and/or serving food is provided to improve various aspects of food catering. A food handling apparatus includes a base platter having a predefined pattern of food location indicators thereon. Food elements are arranged on the base platter according to the predefined pattern. The apparatus includes food cell members configured to cover the food elements, maintain a separation of the food elements one from another, and protect the food elements from damage. The apparatus includes a lid positioned over the food cell members and attached to the base platter. At a serving location, the food cell members are uncovered from the food cell members, thereby revealing the food elements in the predefined pattern without additional handling of the food elements. The food elements can therefore be efficiently transferred through a food catering logistics chain while maintaining quality and appearance, and reducing contamination and illness.

13 Claims, 9 Drawing Sheets

U.S. PATENT DOCUMENTS 2,436,300 A 2/1948 Horr
2,706,592 A 4/1955 Schaller
2,724,538 A 11/1955 Schweich
2,749,018 A 6/1956 Berke
2,751,138 A 6/1956 Laver
2,773,590 A 12/1956 Levinson
2,832,466 A * 4/1958 Sheard ..... 206/396
2,925,213 A 2/1960 Zukoski
3,771,713 A * 11/1973 Davidson ..... 229/120.12
3,861,576 A * 1/1975 Tolaas et al. ..... 229/5.84
3,896,786 A 7/1975 Clevett
4,340,168 A 7/1982 Webinger
4,545,487 A * 10/1985 Asmus ..... 206/508
D290,813 S 7/1987 Forbes, Jr.
4,733,863 A * 3/1988 Novotny ..... 273/429
D316,752 S 5/1991 Ricketts
5,098,013 A * 3/1992 France et al. ..... 229/115
D344,023 S 2/1994 Eisman
5,351,880 A 10/1994 Goudreau
5,397,051 A 3/1995 Liu et al.
6,063,415 A 5/2000 Walters
D440,490 S * 4/2001 Lizzio ..... D9/428
6,276,531 B1 * 8/2001 Andrews ..... 206/521.1
2006/0006214 A1 1/2006 Pavlu et al.

* cited by examiner

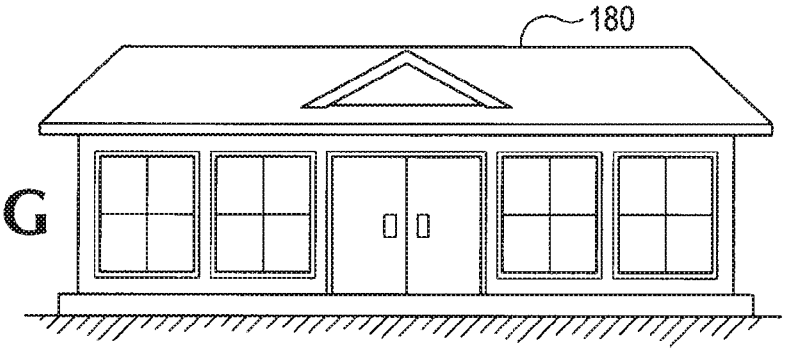
FIG.1G
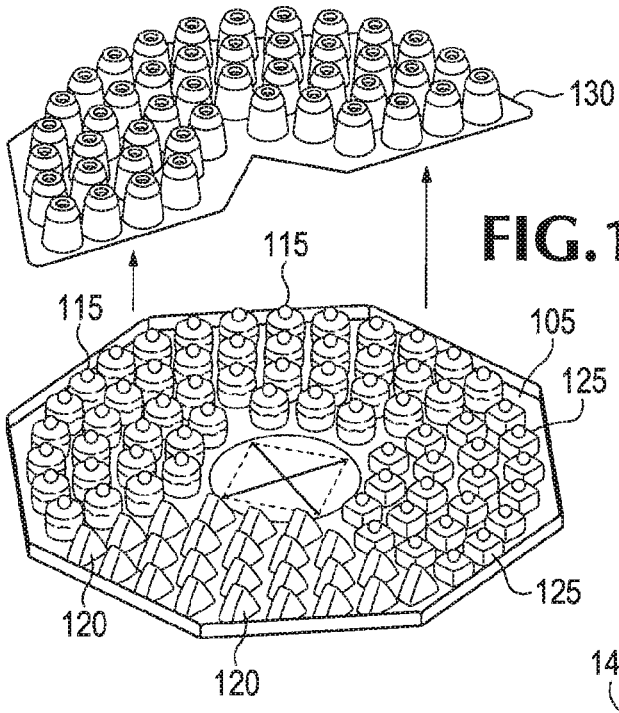
FIG.1H
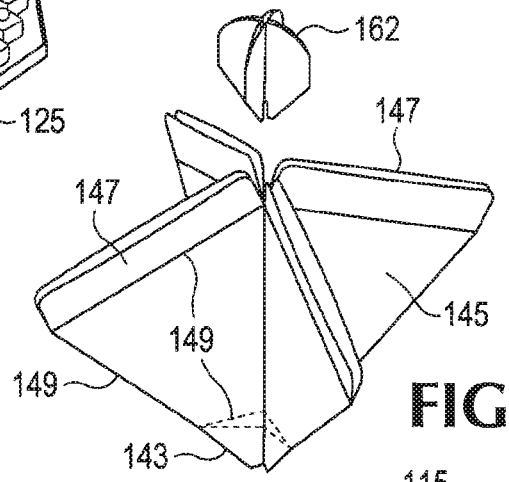
FIG.1I
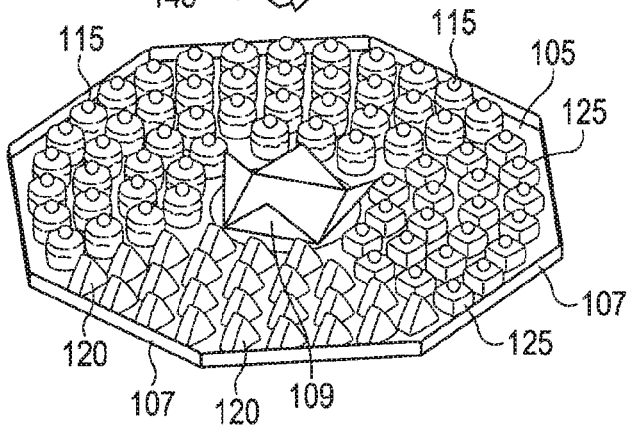

FIG.3A
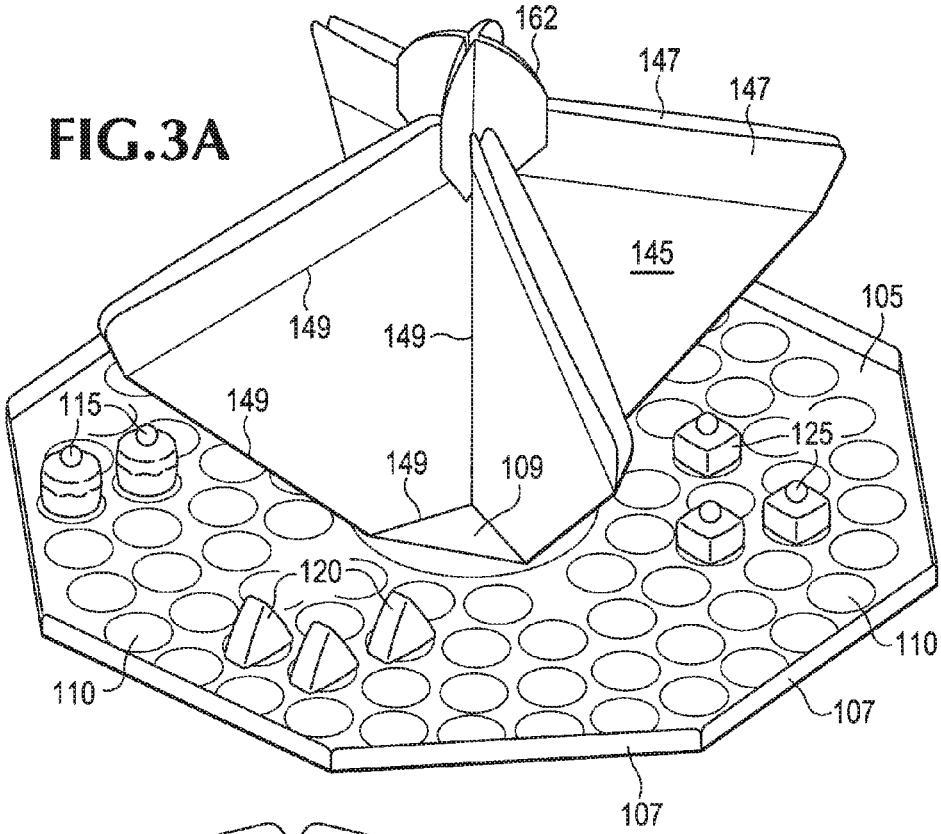
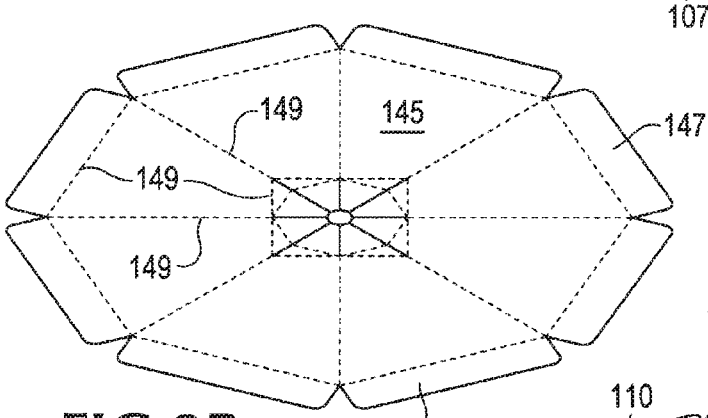
FIG.3B
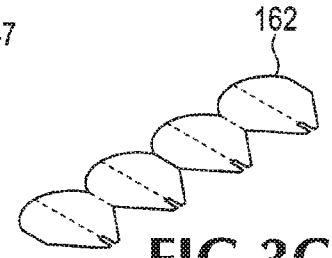
FIG.3C
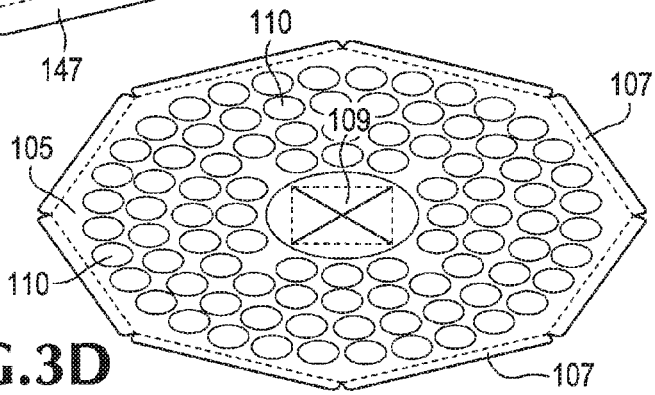
FIG.3D

METHOD AND APPARATUS FOR ARRANGING, TRANSPORTING, AND/OR SERVING FOOD

RELATED APPLICATION DATA

This application is a continuation-in-part of U.S. application Ser. No. 29/280,768, filed Jun. 6, 2007, now U.S. Design Pat. No. D606,396, issued Dec. 22, 2009, which is hereby incorporated by reference.

TECHNICAL FIELD

This disclosure relates to food catering, and, more particularly, to a method and apparatus for arranging, transporting, serving, or otherwise handling food.

BACKGROUND

The food service industry is an important component of the modern economy. One aspect of the food service industry is food catering, or in other words, the business of providing food service at a remote location. Generally, the remote location is different from the location where the food is originally prepared. Businesses often use food catering to meet the food consumption needs or desires of employees at the work place. Organizers of special events, such as weddings, banquets, conventions, and the like, frequently make use of the food catering industry. Individual homeowners even purchase catered food items for parties or special occasions, such as holidays, in the home. These are only a few of the many circumstances where food catering might be desirable.

Food caterers can prepare, transport, and serve hors d'oeuvres, drinks, or even complete meals. Many events require an adherence, for example, to a color or style theme, type of food, arrangement, or other similar requirements for making the food attractive. This enhances the ambience and atmosphere of the event, and as a result, attendees of the event are more likely to become pleased and satisfied. The appearance and presentation of the food can augment such an effort.

Conventionally, food catering is labor intensive. For example, after food and other supplies arrive at the commissary or other suitable preparation facility, cooks may prepare, and if needed, bake the food. Food handlers or food caterers then place the prepared food in a container such as a plastic container, or on a platter, and then cover the container or platter, for example, using cellophane. The containers or platters are then transported to a serving location. Once at the serving location, food handlers remove the cellophane and/or transfer the food from the container or platter to different locations. In other words, to comply with the style theme, arrangement requirements, or other demands, the food must be handled multiple times.

Moreover, the food caterers often carry additional decorative or food supplies to arrange or beautify the food after it arrives at the serving location. The logistic chain is complicated because of the additional decorative or food supplies that must be provided, tracked, and replenished. Putting food in containers at one location and taking the food out at another location to assemble the food to comply with a specific arrangement or style theme, requires a substantial amount of time, and increases the number of times the food is touched or otherwise handled. When humans handle food multiple times, inevitably the risk of food contamination increases, and in the worst cases, can lead to food-transmitted illnesses.

Food is delicate. Cellophane can damage the appearance of food. For example, hors d'oeuvres with icing can have their icing smeared. Small cakes can be smashed or otherwise broken to pieces. Sandwiches can fall apart. One type of food may mingle with another type, resulting in an undesirable combination of food. Such effects are exacerbated by the very nature of food catering, which involves transporting the food in vehicles such as trucks, sometimes over hills or rough roads, or in push carts that can be frequently rattled when pushed over door thresholds, into elevators, and the like. While containers with lids can provide some degree of protection, food can nevertheless be easily damaged, even while located in an ostensibly "safe" container.

Further, every time the food is touched or handled, the chances of ruining the appearance of the food increases, and as previously mentioned, the risk of transmitting illness also increases. Because of the complex aspects of food catering, i.e., from the preparation facility, to the cooks, to the food handlers who pack the food into containers, to the drivers who transport the food from the preparation facility to the serving location, and to the food handlers who again handle the food by unpacking and arranging the food according to various desires, risk of damage and contamination to the food is high.

The presentation of food at a special event can determine the difference between a successful or failed event. Conventional food catering techniques are inadequate to ensure the successful event. If the food is damaged or disorganized, the attendees will be disappointed, unsure about the food's purity, or may altogether refuse to eat. If the food is contaminated, many or all of the attendees might get ill, which on one end of the spectrum can lead to a couple of days of discomfort, and on the other end of the spectrum, can inflict serious and extensive harm on society.

Accordingly, there is a need for improved food catering apparatuses and techniques. Embodiments of the invention address these and other limitations in the prior art.

BRIEF DESCRIPTION OF THE DRAWINGS

FIGS. 1A-1J illustrate various components of a food handling apparatus, including a base platter, food cell members, and a display lid, in addition to techniques for using the same in a food catering logistics flow, according to example embodiments of the present invention.

FIGS. 3A-3D illustrate a first example embodiment of the food handling apparatus.

DETAILED DESCRIPTION

FIGS. 1A-1J illustrate various components of a food handling apparatus, including a base platter 105, food cell members such as 130 and 132, and a display lid 145, among other components, in addition to techniques for using the same in a food catering logistics flow, according to example embodiments of the present invention.

Figure 1A:
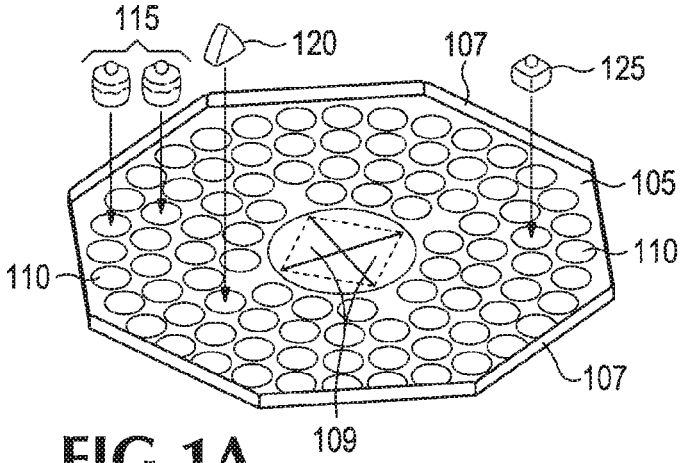

After food and other supplies arrive at the commissary or other suitable preparation facility (not shown), one or more food preparers may prepare, and if needed, bake the food. For example, food elements as shown in FIG. 1A, such as 115, 120, and 125 can be prepared, and if needed, baked. The food elements 115, 120, and 125 can include any type and configuration of food, whether cooked or uncooked. The food elements 115, 120, and 125 can be hors d'oeuvres or byte sized foods, although such is not required. Preferably, the food elements 115, 120, and 125 are attractive, tasty, and pleasing to the human senses. While three different types of food elements are illustrated, it should be understood that any number of types of food elements and any quantity thereof can be used with the inventive aspects disclosed herein.

Referring to FIG. 1A, the base 105 includes a predefined pattern having food location indicators, such as food location indicators 110. The base 105 can be a base platter 105, and will generally be referred to as such herein. The base platter 105 can be constructed using cardboard, paper, wood, plastic, or any other suitable material. Preferably, the base platter 105 is constructed of a stiff paper or cardboard, which is food-safe, lightweight, durable, clean, and recyclable. For the purposes of this disclosure, a food-safe material is one that is constructed to avoid or prevent contamination of food by the material. While the food location indicators, such as 110, are illustrated as circles, any shape may be used, including, a square, a star, a dot, among other possibilities. Moreover, in an alternative embodiment, the food location indicators can include a three dimensional well or nook within the base platter 105. The pattern of food location indicators can be in any predefined arrangement and need not be arranged symmetrically.

Each of the food location indicators are preferably food-safe disposed or printed on the base platter 105. For purposes of this disclosure, the food location indicators are considered food-safe when contamination of the food elements by the food location indicators is avoided or prevented. Generally, the food location indicators are disposed or printed on the base platter 105 at a supply facility (not shown) prior to being shipped to the commissary or other suitable preparation facility.

After the food preparers finish preparing the food elements such as 115, 120, and 125, one or more food handlers can arrange the food elements on the base platter 105. The "food handlers" can be different persons from the "food preparers," although they can also be the same. Moreover, food handlers are sometimes referred to as "food caterers" herein, although the "food caterers" can be different persons from the "food handlers" and the "food preparers" in the sense that inventive aspects of the present invention provide for "food caterers" to cater food without handling the food itself. Moreover, the "food preparers," "food handlers," and "food caterers," need not work for any particular company, but such terms should be construed broadly to include any person using the inventive aspects disclosed herein. Such aspects will be further understood with reference to the following description.

The food handlers can pair each of the food elements, such as 115, 120, and 125, to a corresponding one of the food location indicators, such as 110, according to a predefined pattern as shown, for example, in FIG. 1A. Although three different food element types are shown in FIG. 1A, it should be understood that any number of food element types can be used, and any particular arrangement can be used according to a predefined pattern. Edge flaps 107 provide peripheral support to the base platter 105 and help contain the food elements, among other functions, as explained below. Foldable tabs 109 can be folded along the broken lines, as shown, and can serve as a coupling mechanism, as further described below.

Figure 1B:
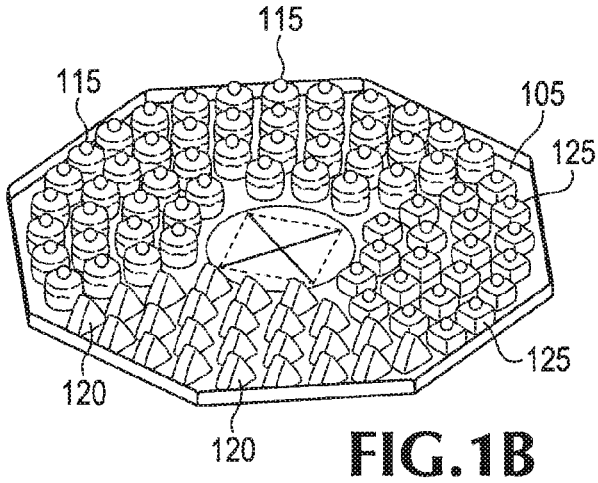

FIG. 1B shows the various food elements such as 115, 120, and 125 placed and arranged according to the predefined pattern on the base platter 105. While all of the food location indicators, such as 110, are shown having a corresponding food element, such is not required. For example, in some embodiments, only portions of the food locations indicators have associated therewith certain food elements.

Figure 1C:
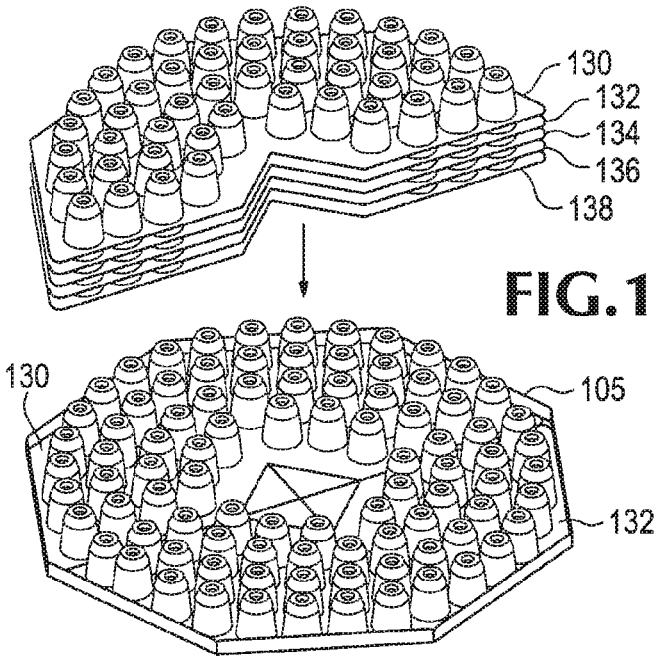

FIG. 1C shows food cell members 130, 132, 134, 136, and 138. Each food cell member includes food cells for covering the food elements. For example, each food cell of food cell member 130 can be paired to a corresponding one of the food location indicators, such as 110, of the predefined pattern. In other words, the food cell members are constructed so that the arrangement of food cells substantially matches, or is otherwise paired to, the arrangement of food location indicators disposed on the base platter 105.

The food cell members can be constructed using plastic, cardboard, paper, wood, or any other suitable material. Preferably, the food cell members are constructed using a food-safe material such as food-safe plastic. As previously mentioned, for the purposes of this disclosure, a food-safe material is one that is constructed to avoid or prevent contamination of food by the material.

The food handlers cover the food elements, such as 115, 120, and 125 with one or more of the food cell members, such as 130 and 132. The food cell members 130 and 132 maintain a separation of each food element from another, and otherwise protect the food cell members. For example, each food element is preserved in substantially its original form using the food cells of the food cell members. The geometric shape and tolerances of the food cell members are such that agitation of the food elements is reduced during shipment and are substantially safeguarded in their original form. Although two separate food cell members 130 and 132 are shown covering the food elements in FIG. 1C, a single food cell member can cover all of the food elements, or alternatively, more than two food cell members can cover different portions of the food elements. The food cell members 103, 132, 134, 136, and 138 can be in a stacked arrangement, as shown in FIG. 1C. The food handlers may then lift the food cell members from the stack and dispose them over the food elements. The stacking features of the food cell members will be described in further detail below.

Figure 1D:
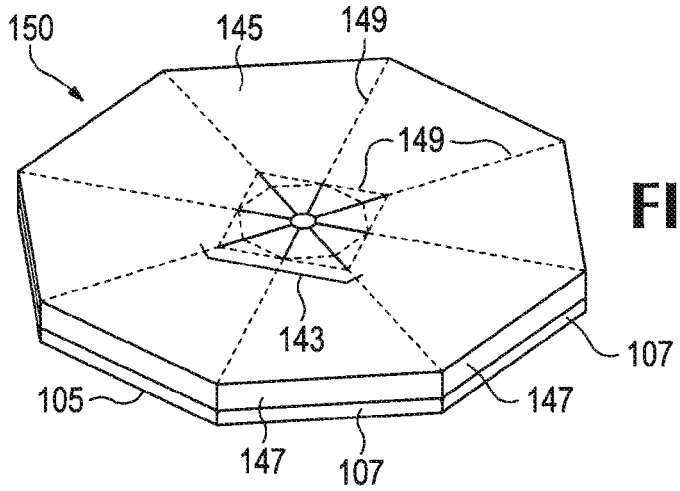

FIG. 1D illustrates a lid 145 configured to be disposed over the food cell members 130 and 132. The lid 145 may be releasably attached to the base platter 105. For example, one or more food caterers can attach edge flaps 147 of the lid 145 to edge flaps 107 of the base platter 105. The edge flaps 147 and 107 can be attached using tape, glue, Velcro®, hooks, or other suitable attaching means. The lid 145 is convertible to a display element using markings 149 and coupling section 143, which will be described in more detail below. The base platter 105 and the lid 145 form a housing 150 for the food elements 115, 120, and 125, and the food cell arrays 130 and 132.

Figure 1E:
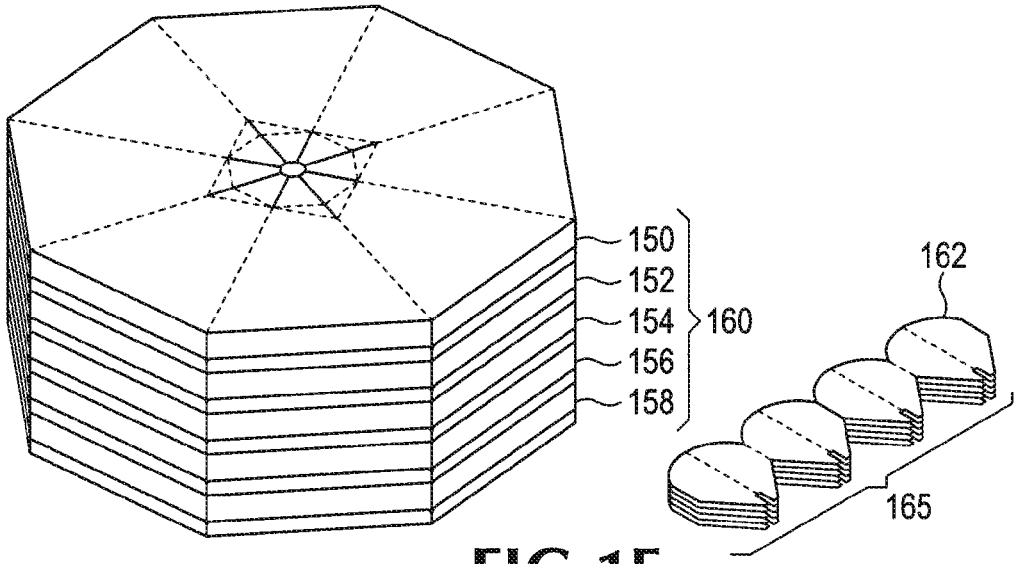

FIG. 1E illustrates the housing 150 stacked on housings 152, 154, 156, and 158, forming a stacked group of housings 160. Crown elements 165 are associated with the stacked housings, and can be shipped or otherwise transported with the stacked housings. For example, crown 162 may be associated with housing 150, and can be included in the housing 150 or separately outside of the housing 150.

The techniques illustrated in FIGS. 1A-1D used to build housing 150 can also be used to build housings 152, 154, 156, and 158. For example, the food preparers can arrange food elements on a base platter associated with housing 152 according to the predefined pattern. Similarly, the food preparers can cover the food elements using the food cell members, and can dispose, or otherwise position, a lid over the food cell members to form the housing 152. As before, the lid can be releasably attached to the base platter, thereby forming the housing 152. While five stacked housings 160 are shown, any number of housings can be stacked.

The ability to stack the housings without damaging the food elements provides a safe and convenient space saving feature. One or more food caterers may stack the housings, for example, in a refrigeration unit or other staging location. The food cell members, such as 130 and 132, provide support and rigidity to the housings during and after the stacking, so that stacks of housings 160 are stable and protective of the food elements.

Figure 1F:
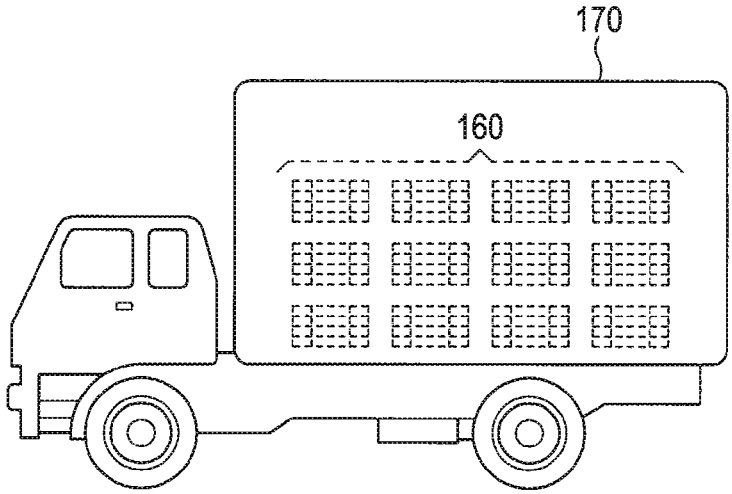

FIG. 1F illustrates the housings 160 being transported, for example, using truck 170. It should be understood that the housings 160 can be transported in a variety of manners, such as by using a cart, some other vehicle besides a truck, or physically carried by one or more food caterers, among other suitable approaches. Generally, the housings of food elements, including the food elements, are transported to a serving location.

FIG. 1G illustrates an example serving location 180. The serving location 180 can include a reception house, a convention center, or a work place, among other suitable serving locations. After arriving at the serving location 180, the food caterers can present, or otherwise efficiently adapt, the housings 160 into a beautiful and accessible pre-arranged offering of food.

FIGS. 1H and 1I show the lid 145 removed from the base platter 105. The food caterers can lift off, or otherwise uncover, the food cell members, such as 130, from the food elements 115, 120, and 125, which are revealed in the predefined pattern. As a result, an attractive presentation of the food elements is efficiently presented with no additional handling of the food elements themselves. The food caterers can fold the lid 145 along predefined markings 149. The markings 149 can include printings on either side of the lid 145, predefined scores on either side of or in the lid 145, or previous folds in the lid 145, among other suitable possibilities. The markings 149 facilitate the folding of the lid 145 into a display element 145 as shown in FIG. 1I.

Figure 1J:
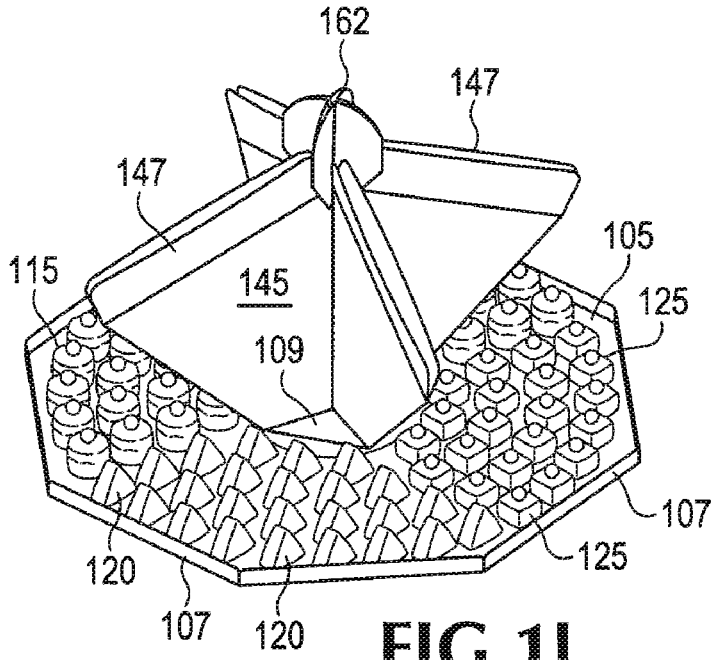

FIG. 1I shows the foldable tabs 109 of the base platter 105 in a folded and open arrangement. The food caterers can attach the coupling section 143 of the lid 145, which includes foldable tabs 143, to the base platter 105. In other words, the food caterers can insert a portion of the folded lid 145 into an opening of the base platter 105 formed by foldable tabs 109, and then fold the foldable tabs 143, thereby attaching the lid 145 to a center region of the base platter 105 when the lid 145 is folded, as shown in FIG. 1J. The edge flaps 147 can be arranged in a substantially symmetrical pattern to beatify, or otherwise direct the attention of event attendees, sometimes referred to herein as "food consumers" to the food elements. While not shown in the figures, the folded lid 145 may include information (not shown) about the food elements, which can be disposed beneath the edge flaps 147 on the flat portions of the lid 145. For example, the type or flavor of the food elements can be displayed. The lid 145 can therefore include a display element 145 to beautify and direct attention to the food elements, or to otherwise display information about the food elements.

The food caterers can secure crown 162 to the folded lid 145. For example, the food caterers may releasably secure the crown 162 to an upper portion of the folded lid 145 so that the edge flaps 147 remain in the substantially symmetrical pattern and access to the food elements is facilitated. As shown in FIG. 1E, the crown 162 can be easily transported in a flat form, and upon arrival at the serving location, the food caterers can fold the crown 162 along predefined markings or scores, into the shape shown in FIG. 1I, and used to secure the folded lid 145.

FIG. 1J shows the base unit including the pre-arranged food elements, the lid 145 converted and coupled to the base unit 105, and the crown 162 securing the lid, thereby facilitating elegant and efficient food catering. The food caterers may serve the food elements to one or more attendees of an event, such as a wedding, a convention, a birthday party, or a charity fundraiser, among other many possibilities.

According to the inventive aspects as disclosed herein, food caterers can simplify the logistics flow of food catering, and quickly and efficiently arrange, transport, and serve a variety of foods in a pleasing pre-arranged pattern. Moreover, the food is handled less often, and therefore, cleanliness is enhanced while contamination and illness are reduced. In addition, requirements for adhering to a particular color or style theme can be more easily and efficiently implemented.

Figure 2:
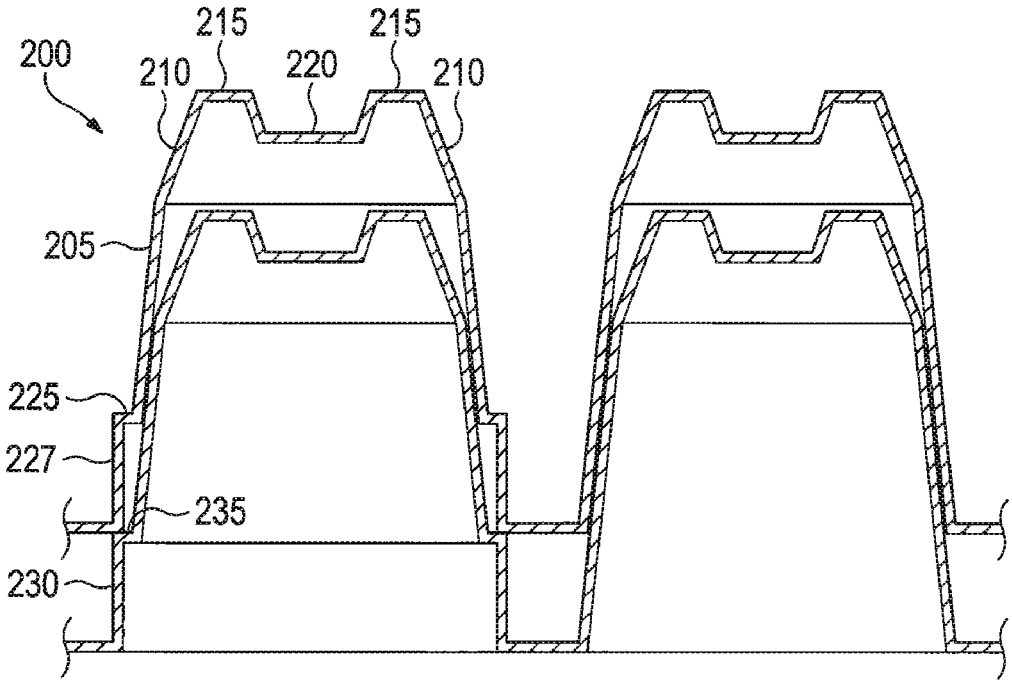
FIG. 2 illustrates a cross-sectional view of the food cell members of FIG. 1C, including inventive aspects to enhance rigidity and stackability of the food cell members, according to example embodiments of the present invention.

FIG. 2 illustrates a cross-sectional view of the food cell members 200, which can correspond, for example, to food cell members 130 and 132 of FIG. 1C. The food cell members 200 include additional aspects to enhance rigidity and stackability of the food cell members, according to example embodiments of the present invention. Each of the food cell members 200 includes food cells, some of which may include an outer cylindrical section 227, an inner substantially cylindrical section 205, and an annular ridge section 225 coupling the outer cylindrical section 227 to the inner substantially cylindrical section 205. The annular ridge section 225 is structured to reduce staking friction. The term "stacking friction" refers to friction as a result of stacking or unstacking the food cell members. For example, a bottom portion of the cylindrical section 227 of one food cell may rest, or otherwise contact, the annular ridge section 235 of another food cell. As a result, the food cell members can be more easily unstacked without "sticking" to one another, and can more easily be stacked in a uniform manner.

At least some of the food cells of the food cell members 200 can include an inwardly tapered upper section 210 having a convex region 215 and a concave region 220, which rigidifies the food cells and reduces stacking friction. The concave region 220 can also help to stabilize the food elements without ruining the appearance of the food elements. Although referred to herein as "convex" and "concave" regions, it should be understood that such regions need not be smooth in nature, but can be arranged at various angles. For example, the convex region 215 can form obtuse angles with the inwardly tapered upper section 210 and the concave region 220, as illustrated in FIG. 2. Other suitable arrangements of the convex and concave regions are possible. The various features of the food cell members 200 provide versatile stacking of the food cell members themselves, protection to the food cell members, and rigid and stabile stacking of the housings containing the food elements, among other benefits.

FIGS. 3A-3D illustrate a first example embodiment of the food handling apparatus. In FIG. 3A, an octagon base platter 105 has arranged thereon food elements 115, 120, and 125, according to the predefined pattern of food location indicators, as discussed in detail above. The food caterers can configure the lid 145 in the folded display arrangement along, for example, folds 149. The crown 162 secures the lid 145 so that one or more food consumers, i.e., people, can access the base platter from all sides.

FIG. 3B shows the lid 145 in a flat or unfolded arrangement, that is, prior to folding the edge flaps 147, or otherwise prior to folding along markings 149, for example. The lid 145 can be more easily transported to the commissary or other suitable preparation facility when the lid 145 is in the flat or unfolded state, as shown in FIG. 3B. Similarly, FIG. 3C shows the crown 162 in a flat or unfolded state, which also facilitates transporting the crown 162 to the preparation facility. Likewise, FIG. 3D shows the base platter 105 in a flat or unfolded state, including the foldable tabs 109. When folded, the lid 145, base platter 105, and crown 162 can be configured to substantially correspond to the illustration of FIG. 3A.

Figure 4A:
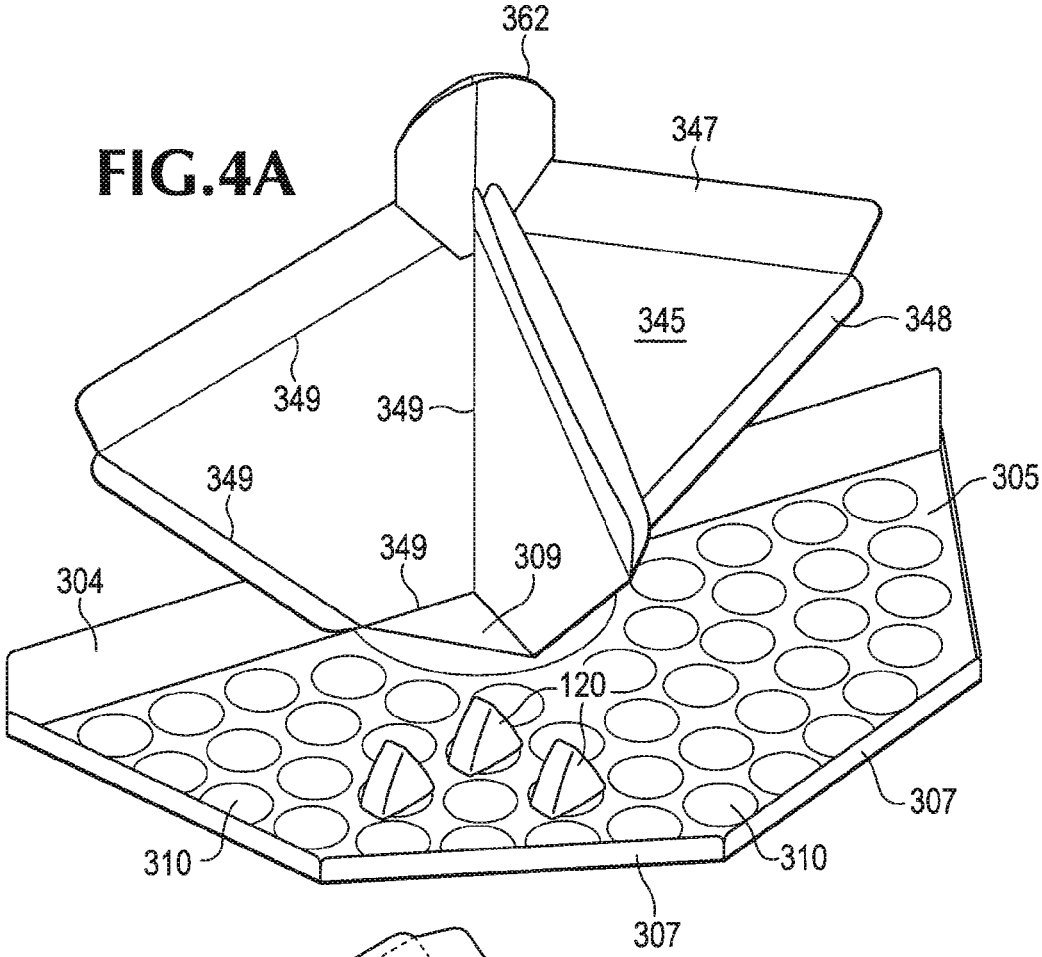
FIGS. 4A-4D illustrate a second example embodiment of the food handling apparatus.

FIGS. 4A-4D illustrate a second example embodiment of the food handling apparatus. In FIG. 4A, a half-octagon base platter 305 has arranged thereon at least some food elements 120, according to the predefined pattern of food location indicators, as discussed in detail above. The food caterers can configure lid 345 in the folded display arrangement along, for example, markings 349. Crown 362 secures the lid 345 so that one or more food consumers, i.e., people, can access the base platter from at least a front side. The base platter 305 can include a back support 304 positionable against a wall. The back support 304 stabilizes the lid 345 and the base platter 105 and also provides a space-saving feature so that food elements can be compactly served to the food consumers.

Figure 4B:
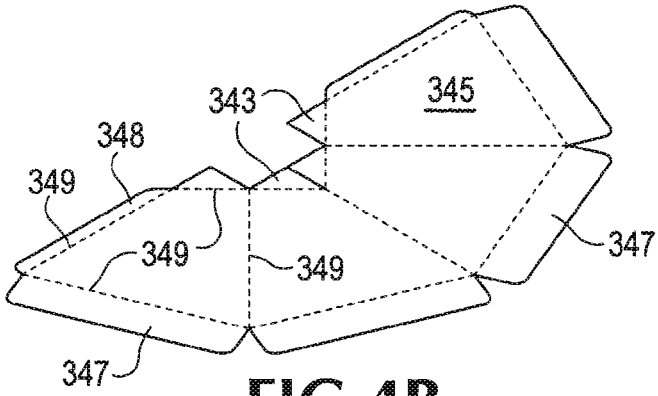
Figure 4C:
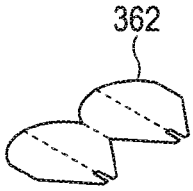
Figure 4D:
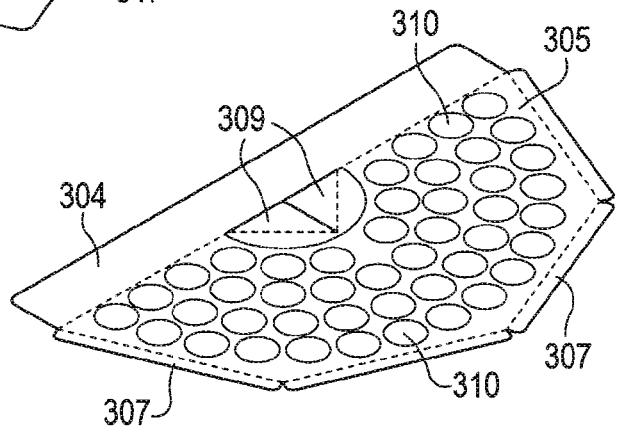

FIG. 4B shows the lid 345 in a flat or unfolded arrangement, that is, prior to folding the edge flaps 347 and 348, or otherwise prior to folding along markings 349, for example. The lid 345 can be more easily transported to the commissary or other suitable preparation facility when the lid 345 is in the flat or unfolded state, as shown in FIG. 4B. Similarly, FIG. 4C shows the crown 362 in a flat or unfolded state, which also facilitates transporting the crown 362 to the preparation facility. Likewise, FIG. 4D shows the base platter 305 in a flat or unfolded state, including the foldable tabs 309, back support 304, and edge flaps 307.

The food caterers can fold the lid 345 including the edge flaps 347 and 348, into a lid to form a housing with the base 305, similar to that described above. Alternatively, the food caterers can fold the lid 345, including the coupling section 343, and edge flaps 347 and 348, as shown in FIG. 4A, i.e., in a "ready-to-serve" configuration where the food elements 120 are accessible to one or more food consumers. To assemble into the ready-to-serve configuration, the food caterers can attach the coupling section 343 of the lid 345, which includes foldable tabs 343, to the base platter 305. In other words, the food caterers can insert a portion of the folded lid 345 into an opening of the base platter 305 formed by foldable tabs 309, and then fold the foldable tabs 343, thereby attaching the lid 345 to a center region of the base platter 305 when the lid 345 is folded, as shown in FIG. 4A. When folded, the lid 345, base platter 305, and crown 362 can be configured to substantially correspond to the illustration of FIG. 4A.

Figure 5A:
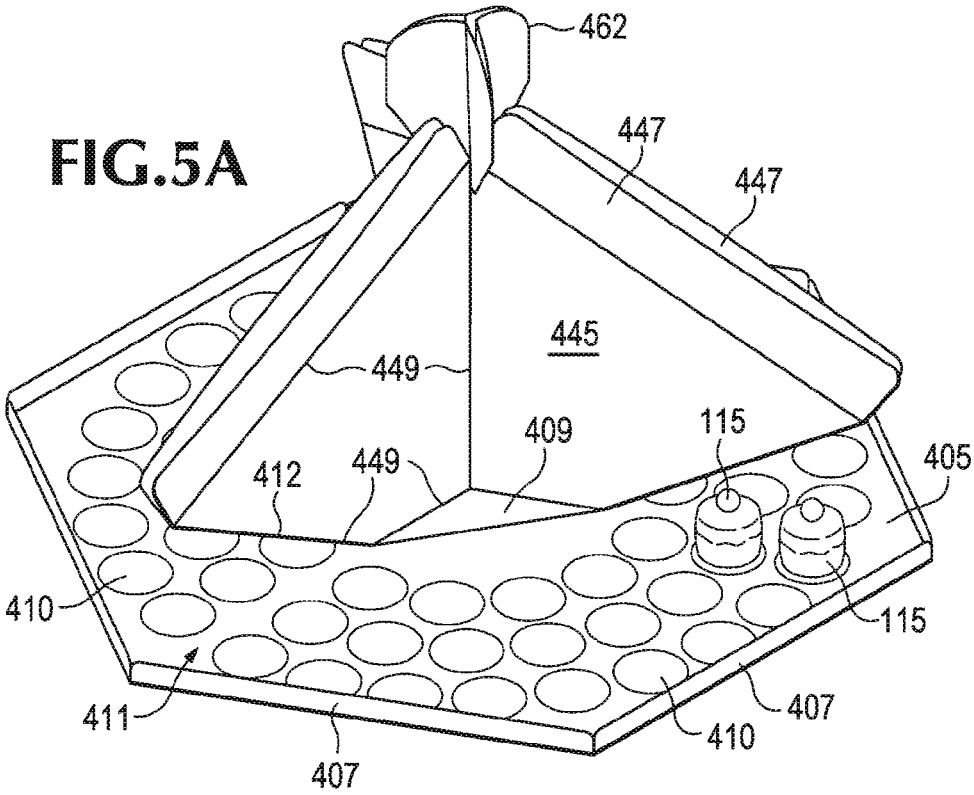
FIGS. 5A-5D illustrate a third example embodiment of the food handling apparatus.

FIGS. 5A-5D illustrate a second example embodiment of the food handling apparatus. In FIG. 5A, a hexagon base platter 405 has arranged thereon at least some food elements 115, according to the predefined pattern of food location indicators, as discussed in detail above. The food caterers can configure lid 445 in the folded display arrangement along, for example, markings 449. Crown 462 secures the lid 445 so that one or more food consumers, i.e., people, can access the base platter from all sides.

Figure 5B:
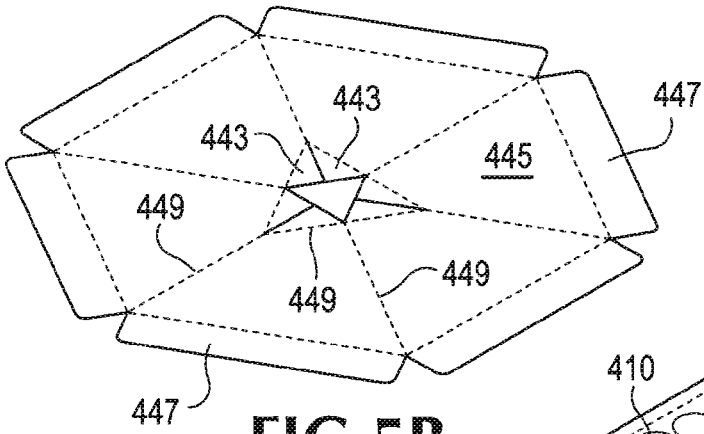
Figure 5C:
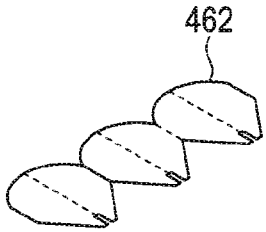
Figure 5D:
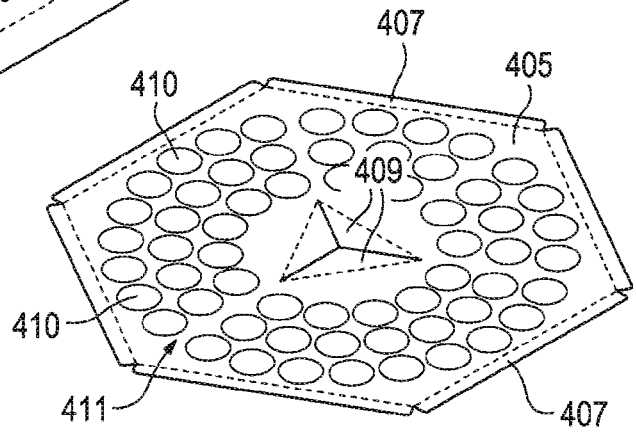

FIG. 5B shows the lid 445 in a flat or unfolded arrangement, that is, prior to folding the edge flaps 447, or otherwise prior to folding along markings 449, for example. The lid 445 can be more easily transported to the commissary or other suitable preparation facility when the lid 445 is in the flat or unfolded state, as shown in FIG. 5B. Similarly, FIG. 5C shows the crown 462 in a flat or unfolded state, which also facilitates transporting the crown 462 to the preparation facility. Likewise, FIG. 4D shows the base platter 405 in a flat or unfolded state, including the foldable tabs 409 and edge flaps 307.

In some embodiments, a gap 411 can be disposed between food location indicators, such as 410. In other words, the gap 411 can separate one group of food location indicators 410 from another group of food location indicators 410. The gap 411 can be aligned with, for example, a section 412 of the folded lid 445 of FIG. 5A. In this manner, contact between the lid 445 and the food elements 115, inadvertent or otherwise, can be avoided. This improves the preservation of the original nature or configuration of the food elements such as 115, and also provides more direct access to the food elements by the food consumers.

The food caterers can fold the lid 445 including the edge flaps 447, into a lid to form a housing with the base 405, similar to that described above. Alternatively, the food caterers can fold the lid 445, including the coupling section 443, and edge flaps 447, as shown in FIG. 5A, i.e., in a "ready-to-serve" configuration where the food elements 120 are accessible to one or more food consumers. To assemble into the ready-to-serve configuration, the food caterers can attach the coupling section 443 of the lid 445, which includes foldable tabs 443, to the base platter 405. In other words, the food caterers can insert a portion of the folded lid 445 into an opening of the base platter 405 formed by foldable tabs 409, and then fold the foldable tabs 443, thereby attaching the lid 445 to a center region of the base platter 405 when the lid 445 is folded, as shown in FIG. 5A. When folded, the lid 445, base platter 405, and crown 462 can be configured to substantially correspond to the illustration of FIG. 5A.

Figure 6A:
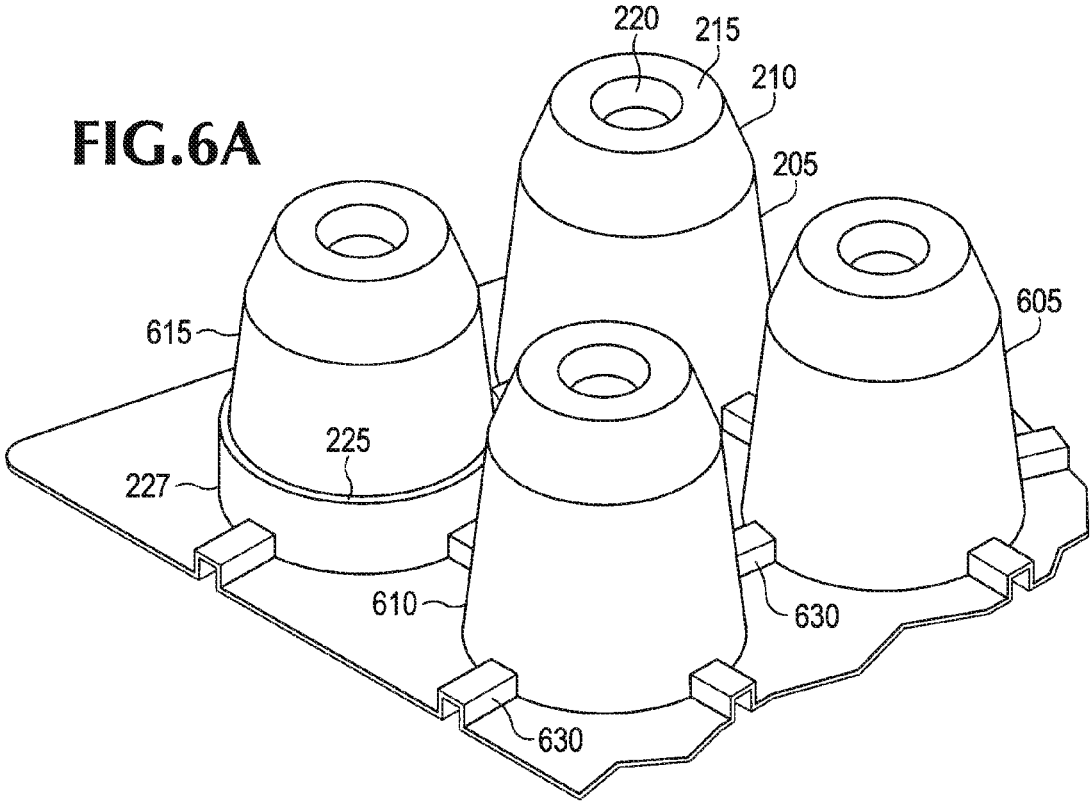
FIGS. 6A-6B illustrate perspective views of portions of the food cell members of FIG. 1C, including grooves for channeling moisture, according to example embodiments of the present invention.
Figure 6B:
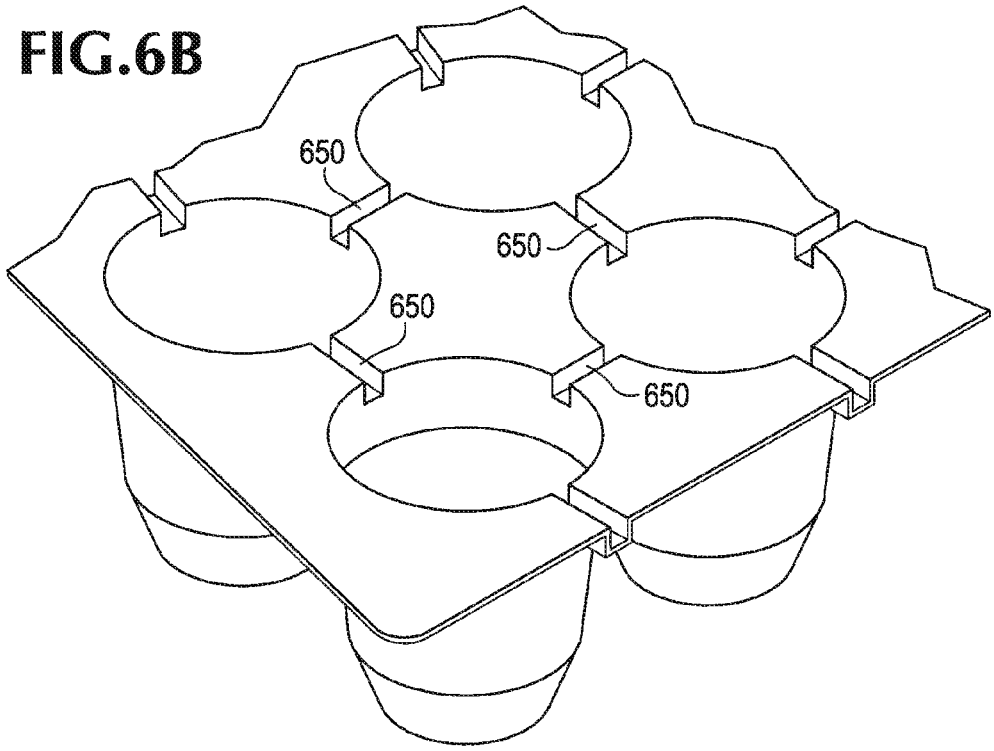

FIGS. 6A-6B illustrate perspective views of portions of the food cell members, such as 130 and 132 of FIG. 1C, including grooves such as 630 and 650 for channeling moisture, or otherwise ventilating the food elements, according to example embodiments of the present invention. As shown in FIG. 6A, some of the food cells such as 615 of the food cell member can include the cylindrical section 227, the substantially cylindrical section 205, and the annular ridge section 225, among other components as previously discussed. Further, the food cells can include the inwardly tapered upper section 210, the convex region 215, and the concave region 220, also as previously discussed.

In particular, the food cell member may include at least one groove, such as 630, between food cells such as 605 and 610. The grooves, such as 630 channel moisture away from the food cells, or otherwise ventilate the food cells. FIG. 6B shows an underside of the food cell member having grooves 650. As can be seen, the grooves 650 can connect multiple food cells. While the grooves shown in FIGS. 6A and 6B have a rectangular appearance, it should be understood that rounded grooves, tunnels, or trenches can also be used.

Figure 7A:
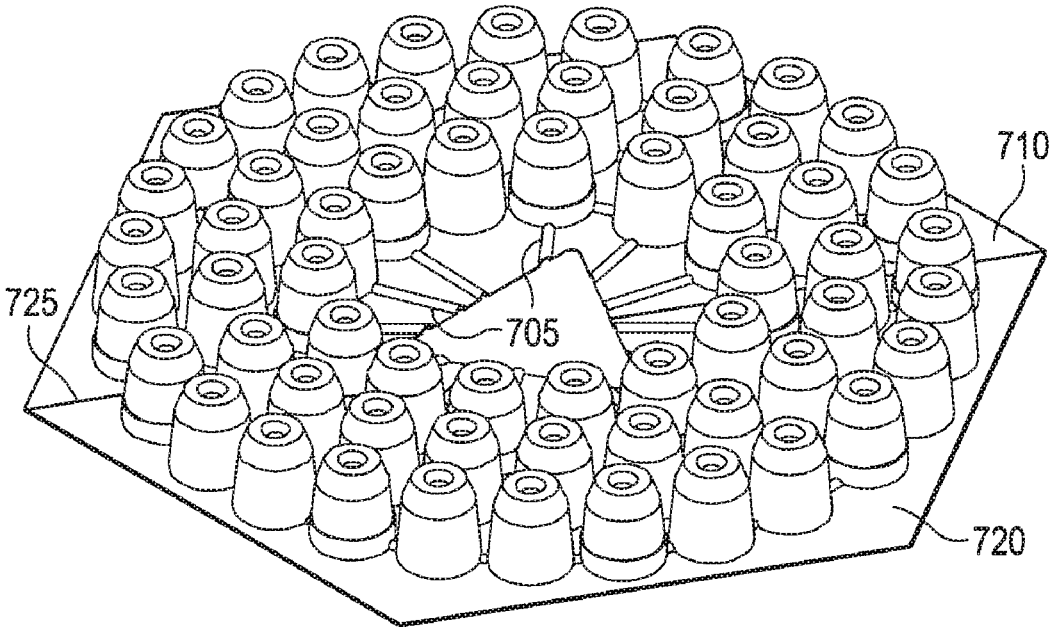
FIGS. 7A-7B illustrate perspective views of the food cell members of FIG. 1C, including the grooves for channeling the moisture toward a center region.
Figure 7B:
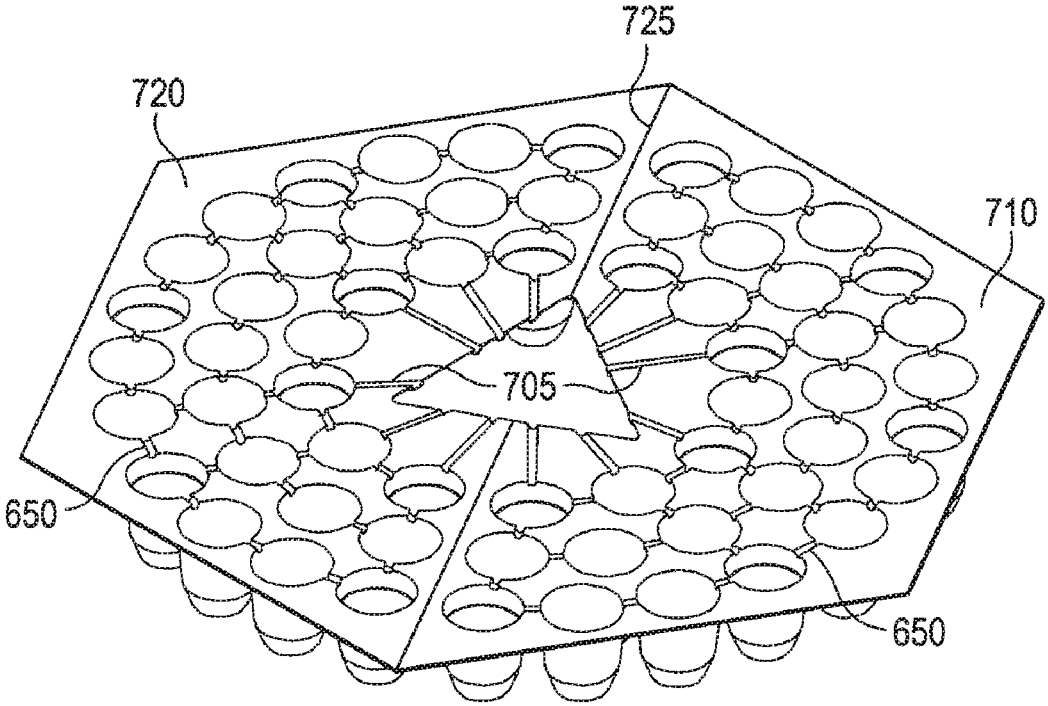

FIGS. 7A-7B illustrate perspective views of the food cell members 710 and 720, which can correspond to, for example, 130 and 132 of FIG. 1C. The food cell members include grooves such as 705 for channeling the moisture toward a center region. As illustrated here, the grooves such as 650 interconnect the various food cells together, and ultimately, the grooves such as 705 guide any moisture toward the center region, thereby escaping the food cells. As a result, the grooves provide ventilation to the food elements. This is particularly useful when the food elements are pre-heated before the food caterers transfer the housings to the serving location. In this manner, unwanted condensation or moisture is guided away from the food elements during or after the pre-heating of the food elements. Moreover, the grooves may also provide ventilation to the food elements after they are originally heated.

From the foregoing it will be appreciated that, although specific embodiments of the invention have been described herein for purposes of illustration, various modifications may be made without deviating from the spirit and scope of the invention. For example, the base platters can be square-shaped or circularly shaped. While the illustrated base platters include certain numbers of food location indicators, any number of food location indicators can be pre-arranged in any pattern. The lids need not be configured as a display element, but rather, could be removed, discarded, or set aside for later use. If the lids are used as the display element, the markings and other folds need not match the ones shown in the figures, and can take any suitable form. If ventilation of the food elements is not desired, then the grooves can be stopped or otherwise blocked. Alternatively, the food cell members need not include any grooves if ventilation is not required. Any number and type of food elements can be used with the disclosed inventive aspects.

Although the embodiments described above include achieving a simplification of the logistics chain of food catering, further enhancements can be made, for example, by providing a user manual of instructions or a "quick setup guide" to help the food caterers quickly configure the food handling apparatus into a "ready-to-serve" assortment. This can be especially useful to the non-professional or occasional food caterer.

Other similar or non-similar modifications can be made without deviating from the intended scope of the invention. Accordingly, the invention is not limited except as by the appended claims.

What is claimed is:

1. A food handling apparatus, comprising:
- a flat base including a predefined pattern having food location indicators; and
- one or more food cell members configured to cover a plurality of food elements according to the predefined pattern,
- wherein each of the one or more food cell members includes:
  - a plurality of spaced apart food cells;
  - a first plurality of grooves structured to ventilate moisture between the plurality of spaced apart food cells; and
  - a second plurality of grooves structured to ventilate moisture from the plurality of spaced apart food cells toward a center region of the food handling apparatus,
- wherein each food cell is directly interconnected with at least two other food cells using the plurality of first grooves, and each food cell is interconnected with the center region using the second plurality of grooves.

2. The food handling apparatus of claim 1, further comprising:
- edge flaps disposed along a periphery of the base; and
- a lid configured to be disposed over the one or more food cell members and releasably attached to the base using the edge flaps.

3. The food handling apparatus of claim 1, wherein the one or more food cell members are configured to maintain a separation of each food element from another on the flat base.

4. The food handling apparatus of claim 1, wherein:
- the plurality of food location indicators of the predefined pattern are printed on the base;
- each of the one or more food cell members comprises a plurality of cells; and
- each of the plurality of cells is paired to a corresponding one of the plurality of printed food location indicators of the predefined pattern.

5. The food handling apparatus of claim 1, wherein the plurality of food location indicators of the predefined pattern are food-safe printed on the base.

6. The food handling apparatus of claim 1, further comprising:
- a first group of printed food location indicators of the base having associated therewith a first type of food element;
- a second group of printed food location indicators of the same base having associated therewith a second type of food elements; and
- a gap separating the first group of food location indicators from the second group of food location indicators.

7. The food handling apparatus of claim 2, wherein:
- all portions of the base are flat within a first plane between the edge flaps disposed along the periphery of the base;
- the lid includes edge flaps disposed along a periphery thereof;
- all portions of the lid between the edge flaps of the lid are flat within a second plane;
- the base and the lid are releasably attached one to another using the edge flaps of the base and the edge flaps of the lid; and
- the base and the lid form a housing for the one or more food cell members and the plurality of food elements.

8. The food handling apparatus of claim 7, wherein the one or more food cell members provide support to the housing and are fully enclosed within the housing using only the base, the lid, the edge flaps of the base and the lid, and means for attaching the edge flaps of the lid to the edge flaps of the base.

9. The food handling apparatus of claim 2, wherein:
- the lid is foldable along predefined markings; and
- the lid is coupled to a center region of the base when folded, wherein:
  - the folded lid extends in a direction perpendicular to the base; and
  - information about the food elements is disposed on the folded lid.

10. A food handling apparatus, comprising:
- a base including a predefined pattern having food location indicators;
- one or more food cell members configured to cover a plurality of food elements according to the predefined pattern; and
- a lid configured to be disposed over the one or more food cell members and releasably attached to the base,
- wherein each of the one or more food cell members includes a plurality of spaced apart food cells, and at least some of the plurality of cells comprise:
  - an outer cylindrical section;
  - an inner substantially cylindrical section; and
  - an annular ridge section coupling the outer cylindrical section to the inner substantially cylindrical section,
  - wherein the annular ridge section is structured to reduce stacking friction,
- wherein each of the one or more food cell members includes:

a first plurality of grooves structured to ventilate moisture between the plurality of spaced apart food cells; and a second plurality of grooves structured to ventilate moisture from the plurality of spaced apart food cells toward a center region of the food handling apparatus, wherein each food cell is directly interconnected with at least two other food cells using the plurality of first grooves, and each food cell is interconnected with the center region using the second plurality of grooves.

11. The food handling apparatus of claim 10, further comprising:

edge flaps disposed along a periphery of the base;

a lid configured to be disposed over the one or more food cell members and releasably attached to the base using the edge flaps, wherein:

the base is flat within a first plane between the edge flaps disposed along the periphery of the base;

the lid includes edge flaps disposed along a periphery thereof;

the lid is flat within a second plane between the edge flaps of the lid;

the base and the lid are releasably attached one to another using the edge flaps of the base and the edge flaps of the lid;

the base and the lid form a housing for the one or more food cell members and the plurality of food elements;

at least some of the plurality of cells further comprise an inwardly tapered upper section having a convex region and a concave region to reduce stacking friction and rigidify the plurality of cells:

an upper surface of the convex region forms an obtuse angle with a surface of the inwardly tapered upper section;

the upper surface of the convex region forms an obtuse angle with a surface of the concave region;

the upper surface of the convex region is flat and parallel to the first plane and the second plane; and the one or more food cell members and the plurality of food elements are fully enclosed within the housing.

12. The food handling apparatus of claim 1, wherein the base is accessible by one or more persons from all sides.

13. The food handling apparatus of claim 1, wherein:

the base further includes a perpendicular back support relative to the base and positionable against a wall; and the base is accessible by a person from at least a front side.

* * * * *